United States Patent [19]

Lepert

[11] Patent Number: 4,721,436

[45] Date of Patent: Jan. 26, 1988

[54] PROCESS AND INSTALLATION FOR CIRCULATING FLUIDS BY PUMPING

[75] Inventor: Claude Lepert, Annecy le Vieux, France

[73] Assignee: Etablissements Pompes Guinard, Courbevoie, France

[21] Appl. No.: 47,628

[22] Filed: May 7, 1987

[30] Foreign Application Priority Data

May 21, 1986 [FR] France ..... 86 07204

[51] Int. Cl.[4] ..... F04D 13/04

[52] U.S. Cl. ..... 417/53; 417/391; 417/406

[58] Field of Search ..... 417/53, 376, 379, 391, 417/406, 407, 408, 409; 60/39.52, 39.41

[56] References Cited

U.S. PATENT DOCUMENTS

| | | | |
|---|---|---|---|
| 975,526 | 11/1910 | Hood | 417/376 |
| 1,842,960 | 1/1932 | Coppus | 417/376 X |
| 3,194,026 | 7/1965 | La Fleur | 417/408 |
| 3,420,434 | 1/1969 | Swearingen | 417/407 |
| 4,035,023 | 7/1977 | Cockrell | 299/17 |
| 4,086,030 | 4/1978 | David | 417/88 |
| 4,233,154 | 11/1980 | Presley | 210/800 |
| 4,285,401 | 8/1981 | Erickson | 166/303 |

FOREIGN PATENT DOCUMENTS

| | | |
|---|---|---|
| 993641 | 11/1951 | France . |
| 2285532 | 4/1976 | France . |
| 2053324 | 2/1981 | United Kingdom . |
| 2057058 | 3/1981 | United Kingdom . |

*Primary Examiner*—Leonard E. Smith

*Attorney, Agent, or Firm*—Pearne, Gordon, McCoy & Granger

[57] ABSTRACT

This pumping installation comprises a source (1) of liquid and a turbo-machine comprising a pump (7) having an intake (8) and an outlet (9) and a turbine (5) which is fixed on the same shaft as the pump (7) and which has an intake (6) and an outlet (4). The outlet (4) of the turbine (5) opens into a conduit communicating the source (1) with the pump (7).

5 Claims, 1 Drawing Figure

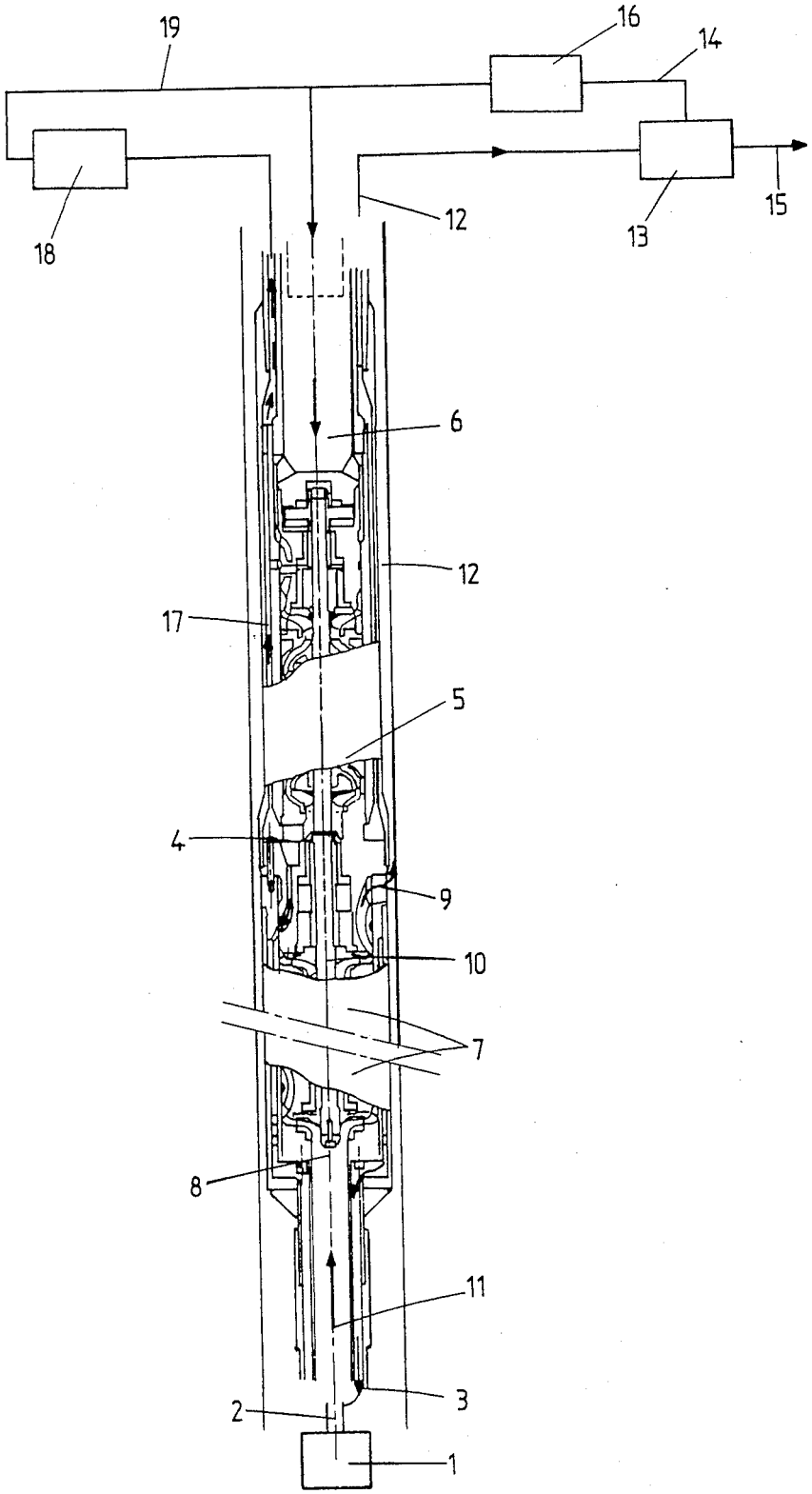
19
16
14
18
12
13
15
6
12
17
5
4
9
10
7
8
11
2
3
1

PROCESS AND INSTALLATION FOR CIRCULATING FLUIDS BY PUMPING

The present invention relates to processes and installations for circulating fluids by pumping. More particularly the invention concerns processes and installations for pumping fluids of high viscosity, for example heavy crude oils which are viscous and which are very difficult to pump with centrifugal hydraulic units.

The process according to the invention comprises passing liquid of lower viscosity than the fluid and miscible therewith, under pressure, to the intake of the turbine of a turbo-machine comprising a pump having an intake and an outlet and a turbine which has an intake and an outlet separate from those of the pump and which is fixed on the same shaft as the pump, mixing with the fluid a part of the expanded liquid which issues from the turbine and drawing in the mixture of the expanded liquid and the fluid by way of the intake of the pump.

The liquid thus serves as a supply fluid for the turbine of the turbo-machine delivering the power required for operation of the pump. The liquid also serves to reduce the viscosity of the fluid and thus make it acceptable so that the mixture of liquid and fluid can be pumped by a centrifugal hydraulic unit.

The process is particularly useful in the case of a borehole where, the liquid having to be passed in any event to the bottom of the borehole where the turbo-machine is disposed, it is immediately accessible at that location without any need for a special conduit system for carrying it thereto.

Preferably the flow rate by volume of the liquid which is passed to the intake of the turbine represents from 0.5 to 3 times the flow rate by volume of the fluid to be pumped. It is advantageous for the flow rate by volume of the liquid mixed with the fluid to be pumped to represent from 0.1 to 0.5 times the flow rate by volume of the fluid to be pumped.

The liquid should be of low viscosity, and miscible with the fluid while reducing the viscosity of the mixture, contain little gas and preferably not react with the fluid. By way of example, for the purposes of pumping a fluid with a viscosity of 100 to 1000 centistokes, the liquid used has a viscosity of 1 to 10 centistokes, giving a mixture whose viscosity is lower than 30 centistokes.

In accordance with an advantageous improvement, the process comprises separating the fluid which issues from the pump into a first liquid stream and a second stream, compressing the first stream, compressing the part of the expanded liquid which issues from the turbine and which is not mixed with the fluids, and combining it with the first compressed stream to pass the whole to the intake of the turbine.

The invention also provides a pumping installation comprising a source of liquid and a turbo-machine comprising a pump having an intake and an outlet and a turbine which is fixed on the same shaft as the pump and which has an intake and an outlet characterised in that the outlet of the turbine opens into a conduit communicating the source with the pump and the installation comprises an apparatus for separation of a fluid into a first less viscous stream and a second more viscous stream, the apparatus being provided with an intake which communicates with the outlet of the pump, and two outlets of which one for the first stream communicates with the intake of the turbine and there is provided a conduit communicating the outlet of the turbine and the outlet of the apparatus, which is intended for the first stream, a compression pump being mounted on said conduit.

The single FIGURE of the accompanying drawing is a diagrammatic sectional, partly broken-away view illustrating the invention.

High-viscosity fluid issues from a source 1 by way of a conduit 2. A conduit 3 coming from the outlet 4 of a turbine 5 of a turbo-machine opens into the conduit 2. The turbo-machine essentially comprises the turbine having the outlet 4 and an intake 6 and a pump 7 having an intake 8 and an outlet 9 and fixed on the same shaft 10 as the turbine 5. A detailed description of that turbo-machine will be found in French Pat. No. 7823 250 which is enclosed herewith by way of reference.

The mixture of viscous fluid and less viscous liquid is passed under a pressure of between 10 and 150 bars by way of a conduit 11 to the intake of the pump 7. The pump 7 discharges it by way of the outlet 9 and a conduit 12 into a separation apparatus 13 where the mixture, possibly after settling or centrifuging in respect of the solid materials, is separated into a first stream which flows by way of the conduit 14, with compression in a pump 16 under a pressure of between 20 and 300 bars, to the intake 6 of the turbine 5, and a second stream which is discharged by way of a conduit 15. The additional amount of liquid which issues from the turbine and which is not passed to the intake of the pump is returned by way of a conduit 17, passing through a pump 18 which puts it under a pressure of between 20 and 300 bars, to a conduit 19 which rejoins the conduit issuing from the pump 16 and going to the intake of the turbine.

The following example illustrates the invention.

55 $m^3/h$ of a light low-viscosity petroleum liquid (5 centistokes) is passed into the turbine, under a pressure of 150 bars. The turbo-machine rotates at 7500 rpm. The manometric height of expansion in the turbine is 1200 meters.

From 10 to 20 parts by volume of the expanded liquid issuing from the turbine is mixed with 35 $m^3/h$ of a crude oil of high viscosity (700 centistokes). The manometric height of the pump is 600 meters.

By virtue of the mixing effect and the reduction in viscosity, it is thus possible to pump the crude oil without difficulty.

I claim:

1. A process for pumping fluid of high viscosity which comprises:

passing liquid of lower viscosity than the fluid and miscible therewith, under pressure, to the intake of a turbine of a turbo-machine comprising a pump having an intake and an outlet and the turbine which has an intake and an outlet separate from those of the pump and which is fixed on a same shaft as the pump to obtain an expanded liquid at the outlet of the turbine, mixing with the fluid a part of the expanded liquid which issues from the outlet of the turbine, to obtain a mixture, and drawing in the mixture of the expanded liquid and the fluid by way of the intake of the pump.

2. The process of claim 1 wherein the flow rate by volume of the liquid passed into the turbine represents from 0.5 to 3 times the flow rate by volume of the fluid to be pumped.

3. The process of claim 1 wherein the flow rate by volume of the liquid mixed with the fluid represents from 0.1 to 0.5 times the flow rate by volume of the fluid.

4. The process of claim 1 which comprises separating the fluid which issues from the pump into a first liquid stream and a second stream, compressing the first stream, compressing the part of the expanded liquid which issues from the turbine and which is not mixed with the fluid, and combining it with the first compressed stream to pass the whole to the intake of the turbine.

5. A pumping installation comprising a source of liquid and a turbo-machine comprising a pump having an intake and an outlet and a turbine which is fixed on a same shaft as the pump and which has an intake and an outlet, wherein the outlet of the turbine opens into a conduit communicating the source with the pump and the installation comprises a separation apparatus for separating a fluid into a first less viscous stream and a second more viscous stream, the apparatus being provided with an intake communication with the outlet of the pump and two outlets of which one for the first stream communicates with the intake of the turbine, and there is provided a conduit communicating the outlet of the turbine and the outlet of the apparatus which is intended for the first stream, a compression pump being mounted on said conduit.

* * * * *